US006946610B2

(12) United States Patent
Takeuchi et al.

(10) Patent No.: US 6,946,610 B2
(45) Date of Patent: Sep. 20, 2005

(54) PUSH SWITCH

(75) Inventors: Masatsugu Takeuchi, Okayama (JP); Hisashi Watanabe, Okayama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 71 days.

(21) Appl. No.: 10/406,673

(22) Filed: Apr. 3, 2003

(65) Prior Publication Data

US 2003/0213686 A1 Nov. 20, 2003

(30) Foreign Application Priority Data

Apr. 4, 2002 (JP) ..... 2002-102343

(51) Int. Cl.[7] ..... H01H 1/06; H01H 13/52; H01H 13/705

(52) U.S. Cl. ..... 200/406; 200/302.2; 200/516

(58) Field of Search ..... 200/5 A, 5 R, 200/512–517, 406, 302.1, 302.2

(56) References Cited

U.S. PATENT DOCUMENTS 4,194,105 A 3/1980 Hodges
4,412,113 A 10/1983 Mitsugi et al.
4,463,233 A 7/1984 Tanabe
5,343,008 A * 8/1994 Ipcinski ..... 200/302.2
5,660,272 A 8/1997 Janniere et al.
5,726,400 A 3/1998 Masuda
6,518,527 B2 * 2/2003 Watanabe et al. ..... 200/406
6,610,950 B1 * 8/2003 Kamio et al. ..... 200/406

FOREIGN PATENT DOCUMENTS

CN 1327605 A 12/2001
EP 1 143 469 A1 10/2001

OTHER PUBLICATIONS

European Search Report for Application No. EP 03 00 7798 Sep. 4, 2003.

* cited by examiner

*Primary Examiner*—James R. Scott
(74) *Attorney, Agent, or Firm*—RatnerPrestia

(57) ABSTRACT

A push switch includes a case made of insulating resin including a plate-like portion shaped substantially like a plate, a first fixed contact exposed at a first surface of the plate-like portion of the case, a second fixed contact exposed at the first surface of the plate-like portion of the case, and a movable contact which electrically connects and disconnects the first fixed contact to the second fixed contact. A first metal member including the first fixed contact further includes a first terminal exposed outside the case, and a first middle portion exposed at a second surface of the plate-like portion of the case, the first middle portion connecting the first fixed contact to the first terminal. A second metal member including the second fixed contact further includes a second terminal exposed outside the case, and a second middle portion for connecting the second fixed contact to the second terminal. The push switch is thin despite the middle portion between the fixed contact and the terminal secured in the portion underneath the recess of the case.

23 Claims, 8 Drawing Sheets

PUSH SWITCH

FIELD OF THE INVENTION

The present invention relates to a push switch used in an operating unit of small-sized electronic equipment, mainly portable equipment, such as a cellular phone, a personal digital assistant (PDA), a digital camera, and a portable audio visual (AV) device.

BACKGROUND OF THE INVENTION

Portable small-sized electronic equipment, such as cellular phones, have been recently required to be multi-functional and to have further-reduced size, weight, and thickness. Functional components of such equipment are also required to have similar features.

A conventional push switch as the functional component will be described with reference to FIG. 10 to FIG. 12.

FIG. 10 is an exploded perspective view of the conventional push switch. FIG. 11 is a sectional view of the switch. FIG. 12 is a sectional view of the switch for showing a central fixed contact cut along a line 12—12 of FIG. 10. A box-like case 1 made of insulating resin has a recess being open upward, and includes a central fixed contact 2 and outer fixed contacts 3 and 3A at the inner bottom of the recess. The outer fixed contacts 3 and 3A are arranged symmetrically about the central fixed contact. The fixed contacts 2 and 3 are connected to a first terminal 4 and a second terminal 5 protruded outside the case 1, respectively.

The first terminal 4 having the central fixed contact 2 at its end and the second terminal 5 having the outer fixed contacts 3 and 3A at its end are formed by punching and bending a conductive metal sheet, and are secured in the case 1 by insert-molding. A middle portion 6 between the central fixed contact 2 and the first terminal 4, and a middle portion 7 between the outer fixed contacts 3, 3A and the second terminal 5 are embedded in the case 1 covering the middle portions completely.

An outer end portion 8A of a dome-shaped movable contact 8 formed of elastic metal sheet is placed on the outer fixed contacts 3 and 3A exposed and fixed at the inner bottom of the recess of the case 1. The movable contact 8 is positioned and accommodated in the recess of the case 1. An underside of a central portion 8B of the movable contact 8 is apart from and opposed to the central fixed contact 2 exposed at the inner bottom of the recess.

As shown in FIG. 12, the middle portion 6 extending from the central fixed contact 2 is bent downward at a position close to an outer end portion of the central fixed contact 2 and is embedded in the resin of the case 1. The middle portion 6 extends to a horizontal portion 6A covered with the resin of the case 1, and is led out as the first terminal 4.

The portion where the horizontal portion 6A corresponds to the position of the outer end portion 8A of the movable contact 8. However, since the horizontal portion 6A is embedded in the resin forming the bottom of the recess of the case 1 as described above, the movable contact 8 does not contact the middle portion 6 of the central fixed contact 2.

The opening of the case 1 is covered with flexible insulation sheet 9 disposed on the case 1.

An operation of a conventional push switch having the above configuration will be described.

When the central portion 8B of the dome-shaped movable contact 8 is pressed via the insulation sheet 9, the dome-shaped portion of the movable contact 8 is reversed with a click feel, and the underside of the central portion 8B then contacts the central fixed contact 2. At this moment, the outer fixed contacts 3 and 3A become conductive with the central fixed contact 2 via the movable contact 8, and the second terminal 5 and the first terminal 4 which are connected to the fixed contact 3, 3A and the fixed contact 2, respectively, become conductive with each other, thus causing the push switch to be turned on.

Upon an operation force being released, the movable contact 8 is restored to its original dome shape rising upward with its elastic restoring force. Then, the underside of the central portion 8B moves away from the fixed contact 2, and thereby, the first terminal 4 and the second terminal 5 are electrically separated, thus causing the switch to be turned off.

In the conventional push switch, the surfaces around the middle portion 6 between the central fixed contact 2 and the first terminal 4, and the surfaces of the middle portion 7 between the outer fixed contact 3, 3A and the second terminal 5 are completely covered with the insulating resin of the case 1. Therefore, as shown in FIG. 12, the resin above and under the middle portions 6 and 7 embedded in the portion underneath the recess of the case 1 has to be thick enough to avoid defective molding of the resin. Particularly in order to prevent the horizontal portion 6A at the middle portion 6 between the central fixed contact 2 and the first terminal 4 from contacting the movable contact 8, the resin necessarily cover the relevant area completely. However, the thickness of the case 1 between the inner bottom surface of the recess and the bottom of the case 1 cannot be reduced more than a limitation, thus preventing the thickness of the push switch including the case 1 from being reduced.

SUMMARY OF THE INVENTION

A push switch includes a case made of insulating resin including a plate-like portion shaped substantially like a plate, a first fixed contact exposed at a first surface of the plate-like portion of the case, a second fixed contact exposed at the first surface of the plate-like portion of the case, and a movable contact which electrically connects and disconnects the first fixed contact to the second fixed contact. A first metal member including the first fixed contact further includes a first terminal exposed outside the case, and a first middle portion exposed at a second surface of the plate-like portion of the case, the first middle portion connecting the first fixed contact to the first terminal. A second metal member including the second fixed contact further includes a second terminal exposed outside the case, and a second middle portion for connecting the second fixed contact to the second terminal.

The push switch is thin despite the middle portion between the fixed contact and the terminal secured in the portion underneath the recess of the case.

DESCRIPTION OF THE PREFERRED EMBODIMENT

Figure 1:
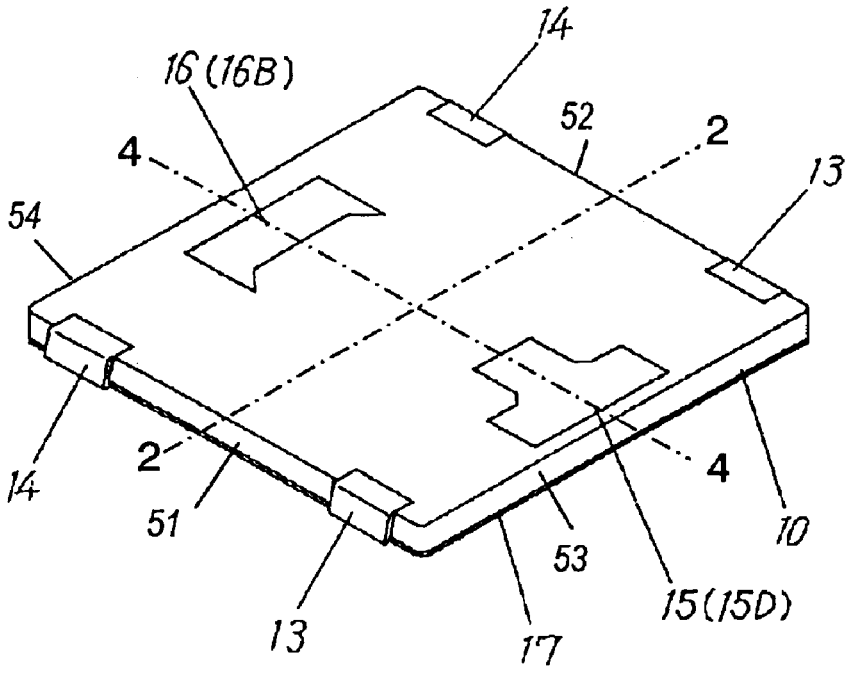
FIG. 1 is a perspective view of a push switch according to exemplary embodiment 1 of the present invention.

A push switch according to exemplary embodiments of the present invention will be described with reference to FIG. 1 to FIG. 9. The same components as those of the conventional push switch are denoted by the same reference numerals, and the detailed description is omitted.

(Exemplary Embodiment 1)

Figure 2:
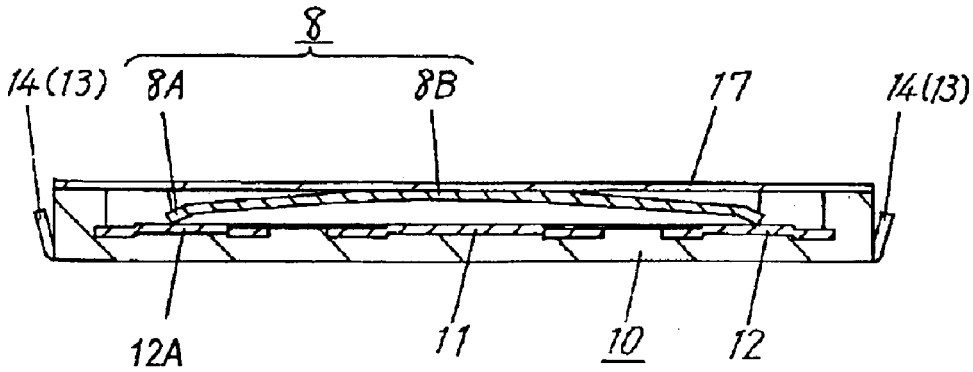
FIG. 2 is a sectional view of the push switch along a line 2—2 of FIG. 1 according to embodiment 1.
Figure 3:
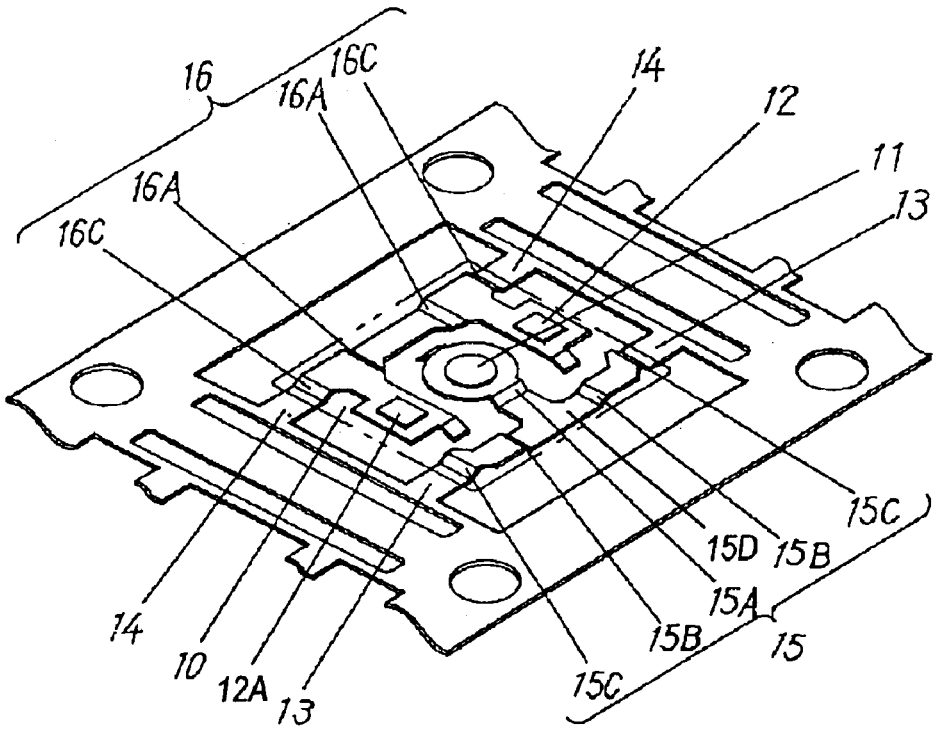
FIG. 3 shows a hoop integrally including fixed contacts and terminals of the push switch according to embodiment 1.
Figure 4:
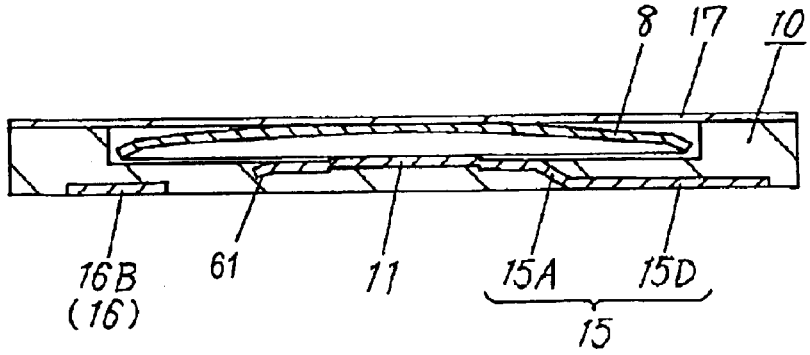
FIG. 4 is a sectional view of the push switch along a line 4—4 of FIG. 1 according to embodiment 1.

FIG. 1 is a perspective view of a push switch according to exemplary embodiment 1 of the present invention. FIG. 2 is a sectional view of the push switch along a line 2—2 of FIG. 1. FIG. 3 shows a hoop integrally including fixed contacts and terminals of the switch. FIG. 4 is a sectional view of the switch along a line 4—4 of FIG. 1.

A box-like case 10 made of insulating resin has a recess opening upward formed therein. The portion corresponding to the recess of the case 10 includes a substantially-plate-like portion having two surfaces opposed to each other. A central fixed contact 11 and outer fixed contacts 12, 12A are provided at the inner bottom of the recess and are secured by insert-molding. The outer fixed contacts 12, 12A are exposed to an outside positions in point-to-point symmetrical relation to each other with respect to the central fixed contact. The fixed contacts 11, 12, and 12A are formed of conductive metal plates as respective one-piece with the first terminal 13 and the second terminal 14 projecting to an outside of the case 10.

The case 10 includes a first side 51 and a second side 52 opposed to each other from which the first terminal 13 and the second terminal 14 are projects, respectively.

The other sides 53 and 54 of the case 10 opposed to each other are flat with no terminal. The line connecting the first terminals 13 on the first side 51 and the second side 52, and the line connecting the second terminals 14 on the sides 51 and 52 are parallel to the sides 53 and 54.

A portion of a middle portion 15 between the central fixed contact 11 and the first terminal 13 and a portion of a middle portion 16 between the outer fixed contact 12, 12A and the second terminal 14 are exposed at the bottom of the case 10 to be mounted on a wiring board or the like.

An outer end portion 8A of the movable contact 8 having an upwardly-convex-dome shape with a circular outside is located on the outer fixed contacts 12 and 12A disposed at the recess of the case 10. The central portion 8B is spaced above the central fixed contact 11 to confronting to the contact 11. As shown in FIG. 4, the middle portion 15 connected to the central fixed contact 11 does not contact the movable contact 8 since the upper surface of the portion 15 is covered with the insulating resin.

A flexible insulation sheet 17 covering the opening of the recess is provided over the upper surface of the case 10.

Figure 10:
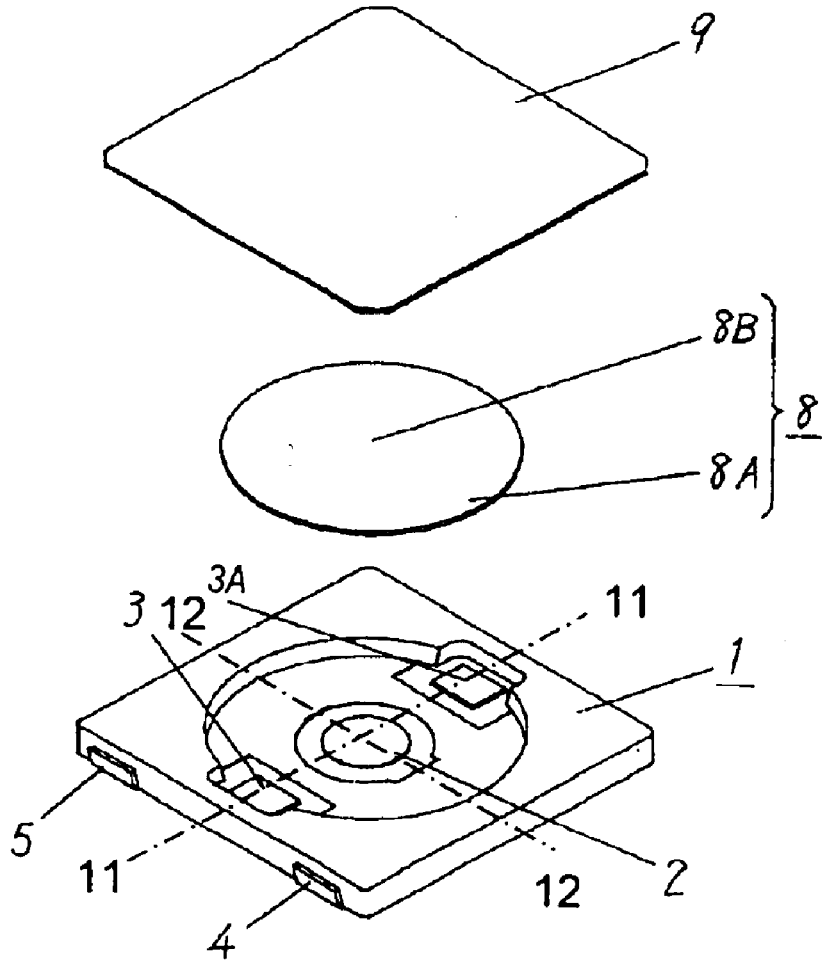
Fig. 10 PRIOR ART
FIG. 10 is an exploded perspective view of a conventional push switch.
Figure 11:
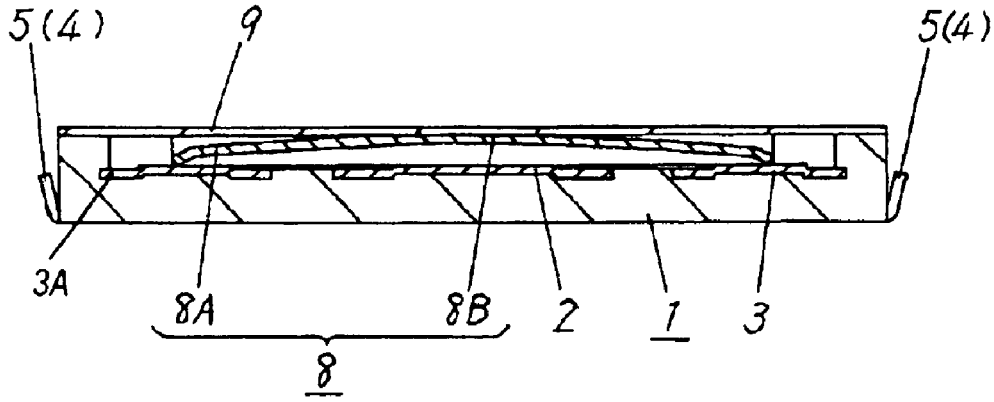
Fig. 11 PRIOR ART
FIG. 11 is a sectional view of the conventional push switch along a line 11—11 of FIG. 10.
Figure 12:
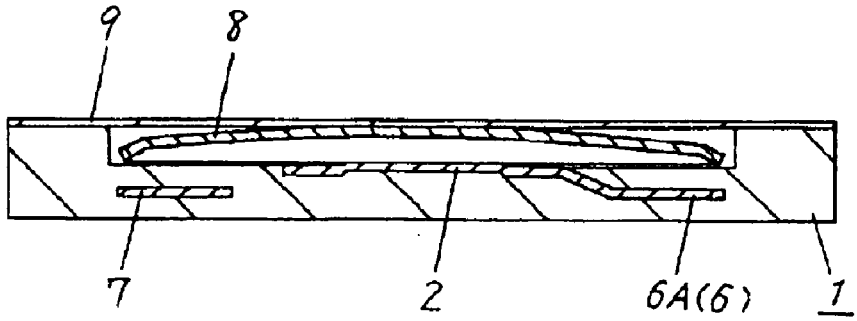
Fig. 12 PRIOR ART
FIG. 12 is a sectional view of the conventional switch along a line 12—12 of FIG. 10.

An operation of the push switch according to embodiment 1 is the same as the conventional push switch shown in FIGS. 10 to 12. A pressing force is applied downward to the central portion 8B of the movable contact 8 from above the insulation sheet 17 in order to reverse the movable point 8 and to turn the switch on.

The push switch of the present invention is characterized in that the middle portion 15 between the fixed contact 11 and the terminal 13, and the middle portion 16 between the fixed contact 12, 12A and the terminal 14 are exposed at the bottom, i.e., a mounting surface of the case 10, which will be explained in detail.

As shown in FIG. 3, regarding the middle portion 15 between the central fixed contact 11 and the first terminal 13, a metal band hoop is processed substantially in a T-shape to form a portion extending from the central fixed contact 11. Both wing ends of the T-shape projects outwardly of the case 10 to serve as the first terminals 13. In FIG. 3, a portion corresponding to one push switch is surrounded by a double-dashed line.

The middle portion 15 before being led out of the case 10 from the central fixed contact 11 is bent downward at the first bending portion 15A near outside of the central fixed contact 11. The underside of the middle portion 15 fixed at the case 10 is aligned in height with the bottom, i.e., the mounting surface of the case 10.

An end extending at the height branches in the T-shape, and is bent up at the second bending portion 15B to have a height allowing the resin to flow in. The end is further bent at the third bending portion 15C to be aligned in height with the first terminal 13 at the position close to an end of the case 10, thereby communicating with the first terminal 13.

A flat portion 15D formed between the first bending portion 15A and the second bending portion 15B has an underside flush with the outer bottom of the case 10, and is exposed at the bottom of the case 10.

Regarding the outer fixed contacts 12, 12A, the second terminals 14, and the middle portion 16, portions extending from the outer fixed contacts 12 and 12A at the same height branches in respective T-shapes. As shown in FIG. 3, respective one wing ends of the T-shapes communicates with each other, and the respective other wing ends are led out of the case 10 as the second terminals 14. A portion between respective one wing ends of the T-shapes communicating with each other is bent downward at first bending portions 16A, thereby forming the flat portion 16B having its underside flush with the outer bottom of the case 10.

Respective other wing ends of the T shapes correspond to the portion close to the end of the case 10, and are bent at second bending portions 16C to be aligned in height with the second terminals 14, thereby communicating with the second terminals 14. The first terminal 13 and the second terminals 14 are led out at the same height.

The flat portions 15D and 16B are located in a position underneath the recess of the case 10.

The thickness of the case 10 between the inner bottom of the recess to the outer bottom of the case 10 is equal to the total of the thickness of the flat portion 15D or 16B and the thickness of the resin at which the resin of case 10 provided on the flat portions 15D and 16B can flow. Accordingly, the position of the inner bottom of the recess of the case 10 may be closer to the bottom of the case 10 than the conventional push switch, thus allowing the case 10 to be thinner than the case of the conventional switch.

The flat portions 15D and 16B exposed at the bottom of the case 10 causes no defective molding of the resin at the portion corresponding to the flat portions and at the portion underneath the recess. As shown in FIG. 4, an upper surface of the flat portion extending from the central fixed contact 11 is covered with the resin, thus being securely insulated from the outer end portion 8A of the movable contact 8.

As described above, the thickness at the recess of the case 10 is equal to the total of the thickness of the flat portion 15D or 16B and the thickness of the resin on the flat portion. Accordingly, the central fixed contact 11, outer fixed contacts 12, 12A, and the portions extending from the outer fixed contacts 12, 12A are exposed to the inner bottom of the recess, but the underneath portion of them is completely covered with the resin that may flow in the underneath portion.

The middle portions 15 and 16 are covered with the resin at portions under and above the middle portions, and covered with the resin partially only above or only under the middle portions. Since communicating around the sides of the middle portions, the resin covers the middle portions easily, thus reliably securing the middle portions 15 and 16.

The fixed contact 11 may have a sloped portion 61 directing downward formed at the end portion of the contact 11 and embedded in the resin. The portion 61 prevents the fixed contacts 11, 12, and 12A from removing or loosening. However, since the sloped portion 61 is positioned in the recess of the case 10, the thickness of resin at the recess has to be determined in consideration with the size of the sloped portion 61.

The push switch according to embodiment 1 is thin since the case 10, which influences the height of the switch, has a reduced height.

Further, the push switch includes the flat portions 15D and 16B exposed at the bottom, i.e., the mounting surface of the case 10, and the flat portions 15D and 16B may be thus used in place of the terminals 13 and 14. That is, the first terminal 13 and the second terminal 14 may be connected mechanically to portions which do not contribute to wiring, such as a dummy pattern. Then, the bottom of the case 10 may contacts a wiring board to electrically connect the flat portions 15D and 16B to signal patterns provided at positions corresponding to the flat portions no the wiring board with conductive adhesive.

Figure 5:
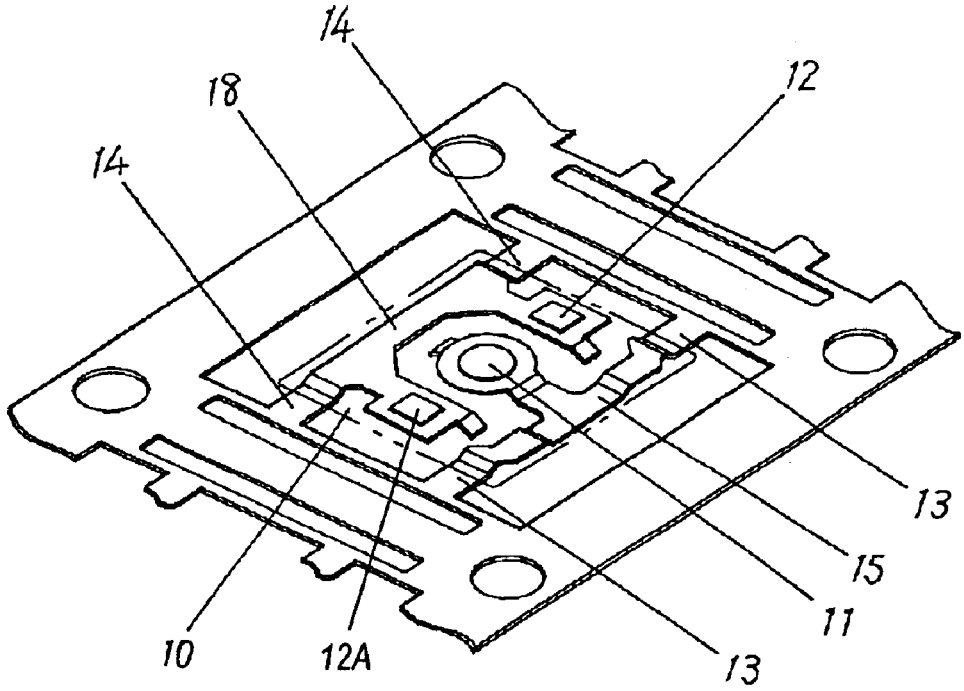
FIG. 5 shows a hoop integrally including fixed contacts and terminals of another push switch according to embodiment 1.

As shown in FIG. 5, the switch may have a middle portion 18 which does not have the first bending portion 16A shown in FIG. 3 between the outer fixed contact 12, 12A and the second terminal 14.

Figure 6:
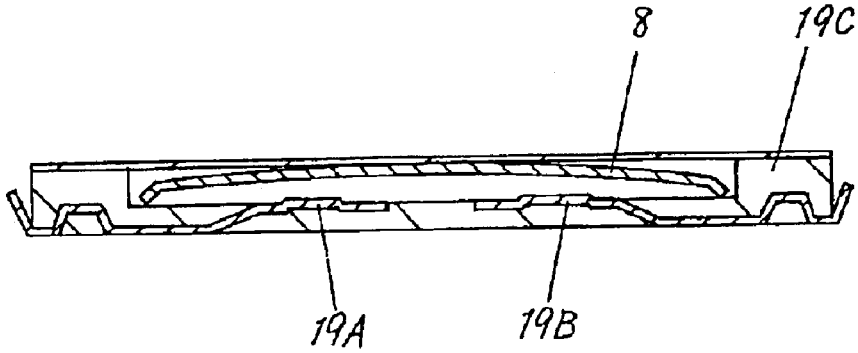
FIG. 6 is a front sectional view of further another push switch according to embodiment 1.

As shown in FIG. 6, a push switch may include a first fixed contact 19A and a second fixed contact 19B which are embedded in resin, and further includes the dome-shaped movable contact 8 which makes the contacts 19A and 19B conductive to each other. The switch includes a case 19C having a reduced thickness, thus having a reduced thickness as its whole structure.

(Exemplary Embodiment 2)

A push switch according to exemplary embodiment 2, additionally to the switch according to embodiment 1, includes a cover functioning as a driver. The same components as those of embodiment 1 are denoted by the same reference numerals, and the detailed description is omitted.

Figure 7:
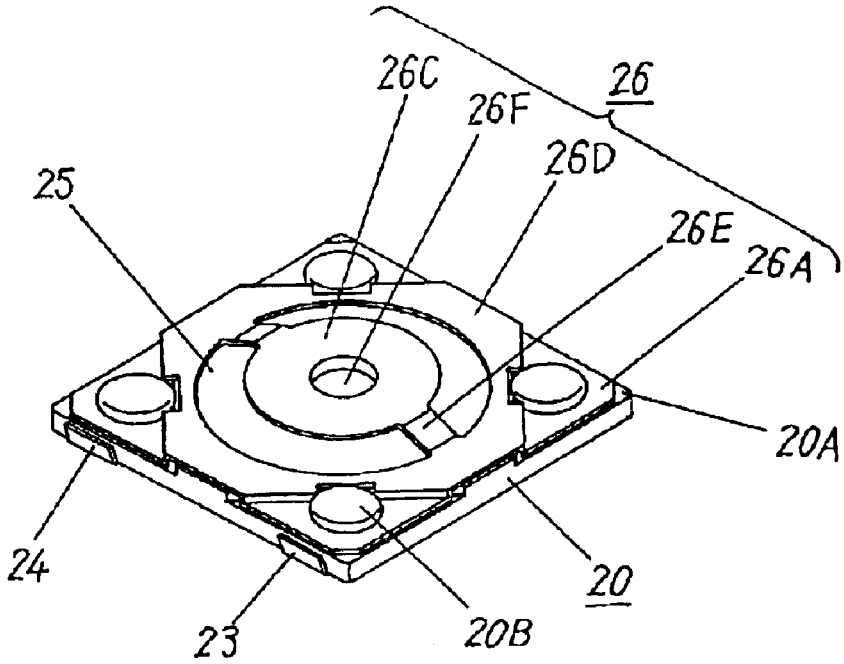
FIG. 7 is a perspective view of a push switch according to exemplary embodiment 2 of the invention.
Figure 8:
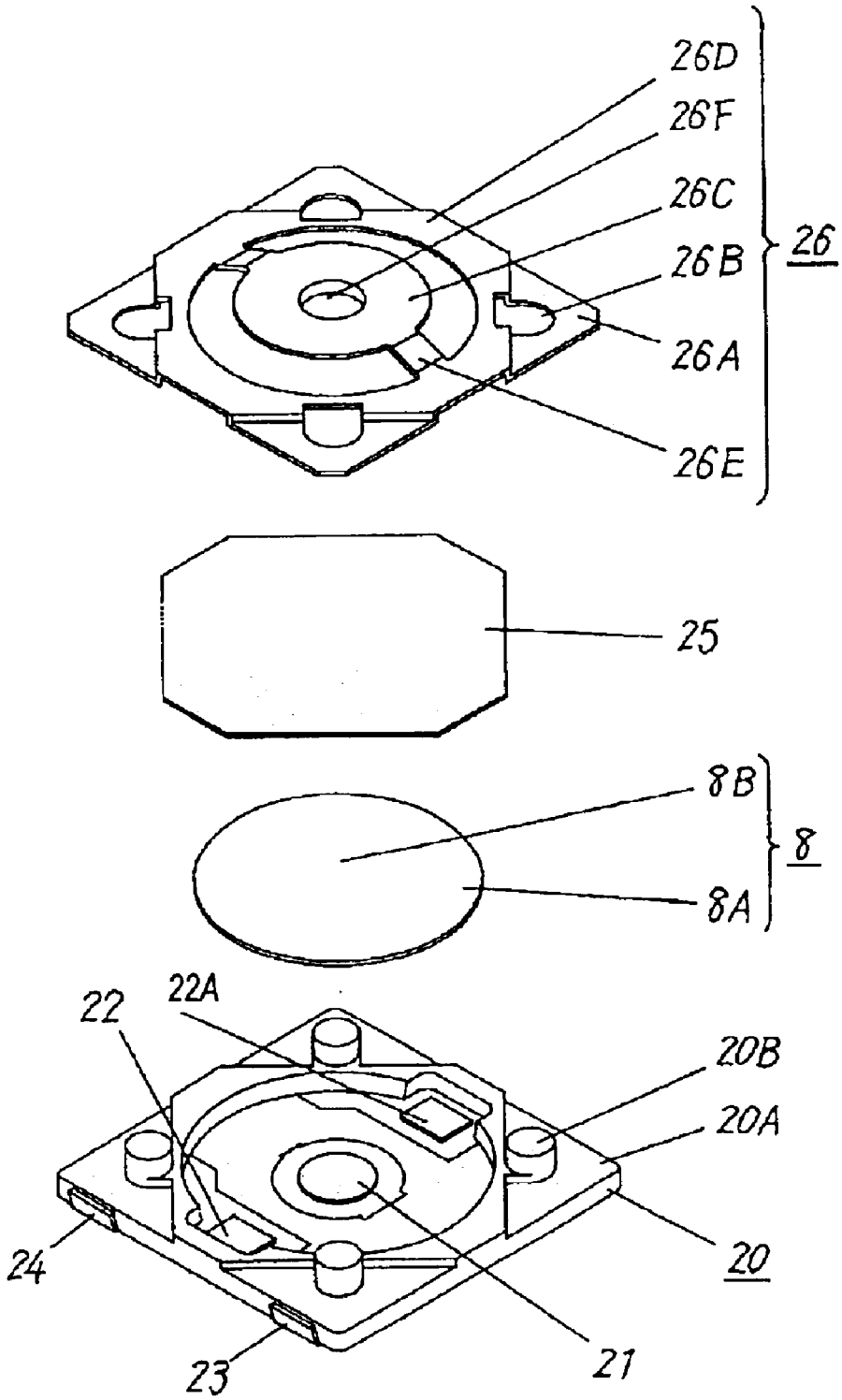
FIG. 8 is an exploded perspective view of the push switch according to embodiment 2.

FIG. 7 is a perspective view of the push switch according to embodiment 2 of the invention. FIG. 8 is an exploded perspective view of the switch. A box-like case 20 made of insulating resin has a recess opening upward formed therein. A central fixed contact 21 and outer fixed contacts 22, 22A are exposed and fixed at the inner bottom of the recess, and are connected to a first terminal 23 and a second terminal 24 led out of the case 20, respectively.

The central fixed contact 21 and the first terminal 23 are integrally formed of a conductive metal plate, and the outer fixed contacts 22, 22A and the second terminal 24 are also integrally formed of a conductive metal plate. The metal plates are secured in the case 20 by insert-molding.

A middle portion between the central fixed contact 21 and the first terminal 23, and a middle portion between the outer fixed contact 22, 22A and the second terminal 24 are secured in the case 20 similarly to the switch of embodiment 1, and the detailed description is thus omitted. The case 20 has a reduced thickness similarly to the case 10 of embodiment 1. Similarly to embodiment 1, an outer end portion 8A of a dome-shaped movable contact 8 is placed on the outer fixed contact 22, 22A. The movable contact 8 is accommodated in the recess. The opening of the case 20 is covered with a flexible insulation sheet 25.

The case 20 has upper four corners 20A thereof formed one step lower than the upper surface of the case, and each of the corners 20A is provided with a columnar projection 20B for caulking.

The cover 26 made of an elastic metal sheet includes a ring-form upper periphery portion 26D corresponding to the upper surface other than the corner 20A of the case 20, and a fixed portion 26A one step lower than the upper periphery portion 26D. The fixed portion corresponds to the corner 20A of the case 20.

The cover 26 is secured on the case 20 by inserting the projection 20B of the case 20 into the round hole 26B formed in the fixed portion 26A, and then by crushing the projection 20B.

The insulation sheet 25 is held between the upper periphery portion 26D of the cover 26 and the upper surface of the case 20, thus not deviating with respect to the cover 26 and the case 20. The positional deviation of the insulation sheet 25 can be further reduced with an adhesive layer provided on the underside of the insulation sheet 25.

Two connections 26E extending from an inner side of the upper periphery portion 26D of the cover 26 communicate with a operating portion 26C at the center of the cover. The connections 26E are shaped in straight and are arranged symmetrically to each other about the center of the operating portion 26C. Arcurate holes opposed to each other are formed between the other inner side of the upper periphery portion 26D and the operating portion 26C. The connections 26E are sloped up toward the center and projects upward. The operating portion 26C is provided with a concavity 26F having a bottom circularly projects downward as the increase of the height of the connection 26E. The concavity 26F is circular as viewed from above. The center of the concavity 26F is coaxial to the center of the movable contact 8. The operating portion 6C at the center is flat except the concavity 26F.

The projections 20B at the four corners of the case 20 which are provided for securing the cover 26 are crushed, thus being lower in height than the upper periphery portion 26D of the cover 26 after the crushing.

In this case, other fixing members, such as screws, may be used in place of the projections 20B. As long as the tops of the fixing members is lower than the upper surface of the cover 26, the members provide the same effect as that of embodiment 2.

In the push switch according to embodiment 2, when a pressing force is applied from above the operating portion 26C of the cover 26, the connection 26E elastically deforms downward, and simultaneously, the operating portion 26C moves downward. Then, the underside of the concavity 26F disposed at the center of the operating portion 26C pushes down the central portion 8B of the movable contact 8 via the flexible insulation sheet 25. Then, when the pressing force is applied to the central portion 8B of the movable contact 8, the dome-shaped portion of the movable contact 8 is reversed with a click feeling, and then, the underside of the central portion 8B contacts the central fixed contact 21 at the inner bottom of the case 20 to turn on the switch.

Since not being higher than the upper periphery portion 26D of the cover 26, the crushed projection 20 does not hinder operations of pressing down the operating portion 26C.

When the pressing force applied to the operating portion 26C of the cover 26 is released, the movable contact 8 is elastically restored to its original dome shape, and then, the connections 26E of the cover 26 are also elastically restored in shape to their original slope, thus having an increasing height toward the center. The elastically-restoring forces of the both turns the switch off.

In the switch according to embodiment 2, the operating portion 26C connected with the upper periphery portion 26D via the connections 26E is integrally disposed at the center of the cover 26. The cover 26 having the elastic connections 26E added thereto functions as a driver for operating the switch. Thus, the switch of embodiment 2 may be a thin push switch having a driver.

Since the operating portion 26C is connected with the upper periphery portion 26D via the connections 26E disposed at two portions opposed to each other, the operating portion is well balanced and connected accurately with the upper periphery portion 26D. This arrangement allows the operating portion 26C to deform little when the switch is actuated and carried. Since the operating force is applied equally to the connections 26E deforming with the force during operation, the operating portion 26C moves reliably. Further, the operating force applied is well balanced and dispersively transferred through the connections 26E to the upper periphery portion 26D.

The concavity 26F at the central portion of the operating portion 26C in pressing operation precisely pushes the central position of the central portion 8B of the movable contact 8 with the central position of the underside of the concavity 26F. This operation enables the movable contact 8 to be smoothly reversed and restored, thereby providing stable operation feeling.

Since the operating portion 26C of the cover 26 is flat except the concavity 26F, the switch can be easily mounted on the wiring board of the equipment employing the switch by a mounting apparatus which attracts the flat portion of the operating portion 26C. Thus, the switch is suited for automatic mounting.

The switch can be mounted on the wiring board by the automatic mounting apparatus which has a circular pin corresponding to the circular concavity 26F disposed at the center of the operating portion 26C and attracts the concavity. In this method, the switch can be accurately positioned and easily mounted on the wiring board.

Figure 9:
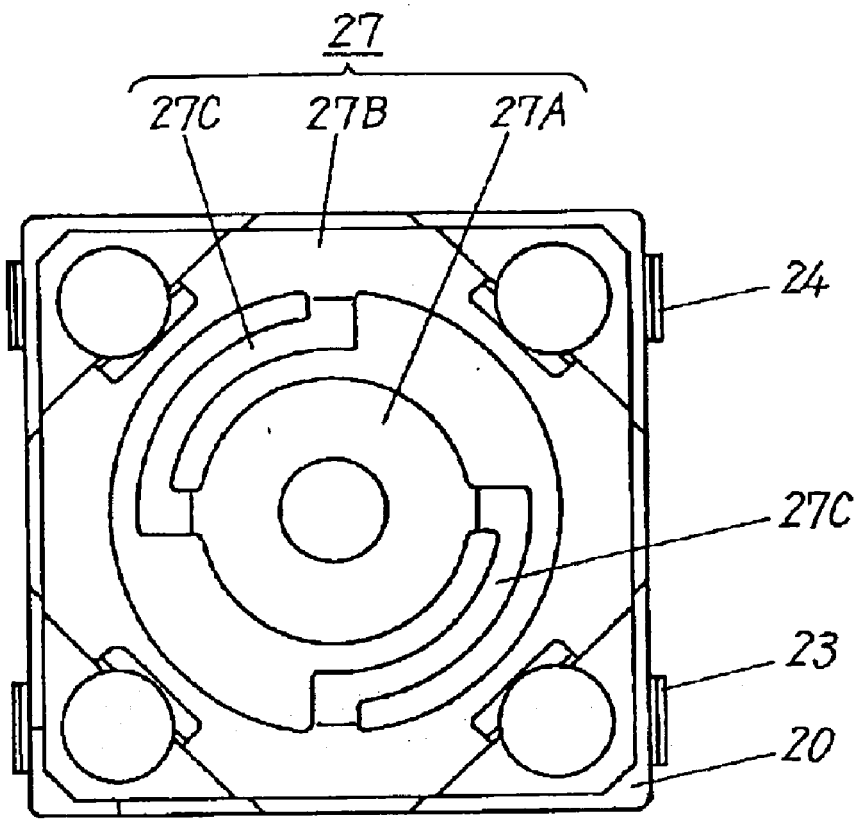
FIG. 9 is a plan view of another push switch according to embodiment 2.

In the above description, the cover 26 includes the straight connections 26E that connect between the operating portion 26C and the upper periphery portion 26D. However, as shown in FIG. 9, the operating portion 27A of cover 27 may be connected to the upper periphery portion 27B with curved-thin-band connections 27C. In this case, since being long, the connection 27C can have a small elastic force and can reduce influence to the operating force in the pushing to operate the switch, thereby providing a clear click feel generated by the movable contact 8.

The cover 26 preferably includes plural connections. The connections for connecting at equal angles between the operating portion 26C and the upper periphery portion 27B assures stable operation of the operating portion.

The cover 26 may be formed of non-metallic material, such as resin, as long as being provided as an elastic sheet.

What is claimed is:

1. A push switch comprising:

a case made of insulating resin including a plate-like portion shaped substantially like a plate;

a first metal member including a first fixed contact exposed at a first surface of said plate-like portion of said case, a first terminal exposed outside said case and exposed at a second surface of said plate-like portion of said case, a first middle portion exposed at said second surface of said plate-like portion of said case, said first middle portion connecting said first fixed contact to said first terminal, a first bending portion provided between said first middle portion and said first terminal, said first bending portion extending from said second surface of said plate-like portion towards said first surface of said plate-like portion to a predetermined height; and a second bending portion provided between said first bending portion and said first terminal, said second bending portion extending from said predetermined height to said second surface of said plate-like portion;

a second metal member including a second fixed contact exposed at said first surface of said plate-like portion of said case, a second terminal exposed outside said case, and a second middle portion for connecting said second fixed contact to said second terminal; and a movable contact which electrically connects and disconnects said first fixed contact to said second fixed contact.

2. The push switch of claim 1, wherein said movable contact is made of a metal plate having a substantially dome shape, and an outer end portion of said movable contact contacts said second fixed contact.

3. The push switch of claim 1, wherein said second metal member further includes a third fixed contact exposed at said first surface of said plate-like portion of said case, and said third fixed contact is connected to said second terminal via said second middle portion.

4. The push switch of claim 3, wherein said movable contact is made of a metal plate having a substantially dome shape, and a outer end portion of said movable contact contacts said second fixed contact and said third fixed contact.

5. The push switch of claim 3, wherein said second fixed contact and said third fixed contact are arranged symmetrically to each other with respect to said first fixed contact.

6. The push switch of claim 1, wherein said second middle portion of said second metal member is exposed at the second surface of said plate-like portion.

7. The push switch of claim 1, wherein said case has a recess formed therein for accommodating said movable contact therein, and said recess have said first surface of said plate-like portion at a bottom thereof.

8. The push switch of claim 7, further comprising an insulating sheet for covering said recess of said case.

9. The push switch of claim 7, further comprising a cover formed of a elastic sheet including a periphery portion arranged over a surface around said recess of said case, an operating portion arranged over said first fixed contact, and a connection for connecting said periphery portion to said operating portion.

10. The push switch of claim 9, further comprising an insulating sheet held between said surface around said recess of said case and said periphery portion of said cover, said insulating sheet covering said recess.

11. The push switch of claim 9, wherein said cover is made of metal.

12. The push switch of claim 9, wherein said operating portion of said cover includes a portion projecting toward said movable contact.

13. The push switch of claim 9, further comprising a fixing member for fixing said cover to said case, wherein said case includes a step portion lower than said surface around said recess of said case, wherein said cover further includes a portion corresponding to said step portion of said case, and wherein said fixing member fixes said cover at said step portion of said case, and having a top thereof lower than said cover.

14. The push switch of claim 13, wherein said fixing member includes a projection provided at said step portion of said case, and wherein said cover has a hole formed therein through which said projection of said case is inserted.

15. The push switch of claim 14, wherein said cover is secured by crushing said top of said projection of said case.

16. The push switch of claim 9, wherein said connection of said cover includes a plurality of connections.

17. The push switch of claim 16, wherein said plurality of connections are disposed at equal intervals from one another.

18. The push switch of claim 9, wherein said connection of said cover has a curved thin-band shape.

19. a push switch comprising:

a case made of insulating resin including a plate-like portion shaped substantially like a plate, wherein said case has a recess formed therein, and said recess has said first surface of said plate-like portion at a bottom thereof;

a first metal member including a first fixed contact exposed at a first surface of said plate-like portion of said case, a first terminal exposed outside said case, and a first middle portion exposed at a second surface of said plate-like portion of said case, said first middle portion connecting said first fixed contact to said first terminal;

a second metal member including a second fixed contact exposed at said first surface of said plate-like portion of said case, a second terminal exposed outside said case, and a second middle portion for connecting said second fixed contact to said second terminal;

a movable contact which electrically connects and disconnects said first fixed contact to said second fixed contact, said movable contact being accommodated in said recess of said case;

a cover formed of an elastic sheet including a periphery portion arranged over a surface around said recess of said case, an operating portion arranged over said first fixed contact, and a connection for connecting said periphery portion to said operating portion; and an insulating sheet held between said surface around said recess of said case and said periphery portion of said cover, said insulating sheet covering said recess.

20. A push switch comprising:

a case made of insulating resin including a plate-like portion shaped substantially like a plate, wherein said case has a recess formed therein, and said recess has said first surface of said plate-like portion at a bottom thereof;

a first metal member including a first fixed contact exposed at a first surface of said plate-like portion of said case, a first terminal exposed outside said case, and a first middle portion exposed at a second surface of said plate-like portion or said case, said first middle portion connecting said first fixed contact to said first terminal;

a second metal member including a second fixed contact exposed at said first surface of said plate-like portion of said case, a second terminal exposed outside said case, and a second middle portion for connecting said second fixed contact to said second terminal;

a movable contact which electrically connects and disconnects said first fixed contact to said second fixed contact, said movable contact being accommodated in said recess of said case;

an insulating sheet for covering said recess of said case; and a cover formed of an elastic sheet including a periphery portion arranged over a surface around said recess of said case, an operating portion arranged over said first fixed contact, and a connection for connecting said periphery portion to said operating portion, wherein said cover is made of metal.

21. A push switch comprising:

a case made of insulating resin including a plate-like portion shaped substantially like a plate, wherein said case has a recess formed therein, and said recess has said first surface of said plate-like portion at a bottom thereof;

a first metal member including a first fixed contact exposed at a first surface of said plate-like portion of said case, a first terminal exposed outside said case, and a first middle portion exposed at a second surface of said plate-like portion of said case, said first middle portion connecting said first fixed contact to said first terminal;

a second metal member including a second fixed contact exposed at said first surface of said plate-like portion of said case, a second terminal exposed outside said case, and a second middle portion for connecting said second fixed contact to said second terminal;

a movable contact which electrically connects and disconnects said first fixed contact to said second fixed contact, said movable contact being accommodated in said recess of said case;

an insulating sheet for covering said recess of said case; and a cover formed of an elastic sheet including a periphery portion arranged over a surface around said recess of said case, an operating portion arranged over said first fixed contact, and a connection for connecting said periphery portion to said operating portion, wherein aid connection of said cover includes a plurality of connections.

22. The push switch of claim 21, wherein said plurality of connections are disposed at equal intervals from one another.

23. A push switch comprising:

a case made of insulating resin including a plate-like portion shaped substantially like a plate, wherein said case has a recess formed therein, and said recess has said first surface of said plate-like portion at a bottom thereof;

a first metal member including a first fixed contact exposed at first surface of said plate-like portion of said case, a first terminal exposed outside said case, and a first middle portion exposed at a second surface of said plate-like portion of said case, said first middle portion connecting said first fixed contact to said first terminal;

a second metal member including a second fixed contact exposed at said first surface of said plate-like portion of said case, a second terminal exposed outside said case, and a second middle portion for connecting said second fixed contact to said second terminal;

a movable contact which electrically connects and disconnects said first fixed contact to said second fixed contact, said movable contact being accommodated in said recess of said case;

an insulating sheet for covering said recess of said case; and a cover formed of an elastic sheet including a periphery portion arranged over a surface around said recess of said case, an operating portion arranged over said first fixed contact, and a connection for connecting said periphery portion to said operating portion, wherein said connection of said cover has a curved thin band shape.

* * * * *

UNITED STATES PATENT AND TRADEMARK OFFICE

CERTIFICATE OF CORRECTION

PATENT NO. : 6,946,610 B2
DATED : September 20, 2005
INVENTOR(S) : Masatsugu Takeuchi et al.

It is certified that error appears in the above-identified patent and that said Letters Patent is hereby corrected as shown below:

Column 10,
Line 12, delete "or" and insert -- of --.
Line 66, delete "aid" and insert -- said --.

Signed and Sealed this

Fourth Day of April, 2006

JON W. DUDAS
*Director of the United States Patent and Trademark Office*